US006592298B2

(12) United States Patent
Beltrani

(10) Patent No.: US 6,592,298 B2
(45) Date of Patent: Jul. 15, 2003

(54) BUOYANCY COMPENSATOR FOR SCUBA DIVERS

(75) Inventor: Giovanni Battista Beltrani, Genoa (IT)

(73) Assignee: Technisub SpA, Genoa (IT)

( * ) Notice: Subject to any disclaimer, the term of this patent is extended or adjusted under 35 U.S.C. 154(b) by 0 days.

(21) Appl. No.: 09/949,142

(22) Filed: Sep. 10, 2001

(65) Prior Publication Data

US 2002/0057946 A1 May 16, 2002

(30) Foreign Application Priority Data

Sep. 11, 2000 (IT) ..... TO2000A0856
Sep. 11, 2000 (IT) ..... TO2000A0855

(51) Int. Cl.[7] ..... B63C 11/02
(52) U.S. Cl. ..... 405/186; 441/96
(58) Field of Search ..... 441/96, 92, 90; 405/186

(56) References Cited

U.S. PATENT DOCUMENTS 3,967,459 A * 7/1976 Denis ..... 405/186
4,000,534 A * 1/1977 Cerniway et al. ..... 405/186
4,720,281 A 1/1988 Matsuoka
5,199,820 A * 4/1993 Nicklo ..... 405/186
5,256,094 A * 10/1993 Canna ..... 405/186
5,505,559 A 4/1996 Hermansen
5,520,485 A * 5/1996 Hermansen ..... 405/186
5,522,679 A * 6/1996 Eungard ..... 405/186
5,707,177 A * 1/1998 Lehrer et al. ..... 405/186
5,746,543 A * 5/1998 Leonard ..... 405/186
5,788,415 A * 8/1998 Chen ..... 405/186
5,803,667 A 9/1998 Seligman
5,823,713 A * 10/1998 Biran ..... 405/186
5,957,079 A * 9/1999 Wessels ..... 405/186
6,039,043 A * 3/2000 Graber et al. ..... 405/186

FOREIGN PATENT DOCUMENTS

DE 88 01 870 U 7/1988
EP 0 693 422 A 1/1996

* cited by examiner

*Primary Examiner*—Frederick L. Lagman
(74) *Attorney, Agent, or Firm*—Sughrue Mion, PLLC

(57) ABSTRACT

A buoyancy compensator for scuba divers having an integrated system for controlling the functions of inflation and discharge, which comprises a single control (20) stably connected to the inflatable vest (1) in a fixed position readily accessible by the scuba driver, and designed to perform the functions of inflation, by use of a push-button valve (21, 22), and of remote discharge, by use of a purely mechanical remote control consisting of a maneuvering lever (26) which acts on a sheathed flexible cable (11, 12) in such a way as to exert a tensile force on the obturator (9) of a discharge valve (5) located on the vest (1) in a hydrostatically advantageous position and, in any case, a position at a distance from the single control (20). The inflatable vest (1) may have a mixed one bag/two bags construction.

16 Claims, 8 Drawing Sheets

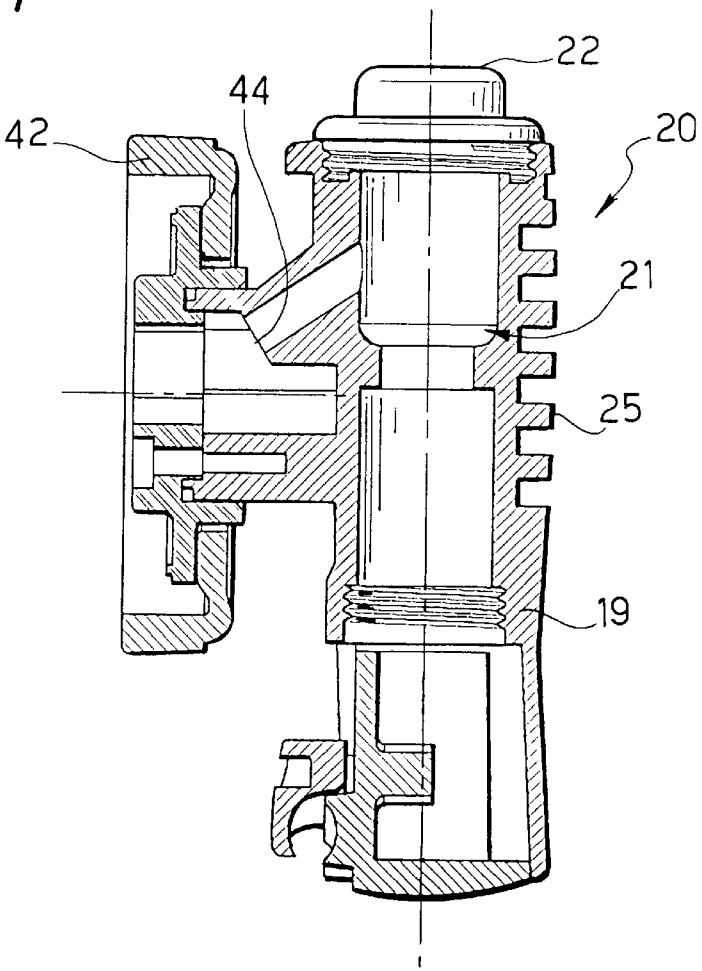
FIG. 7
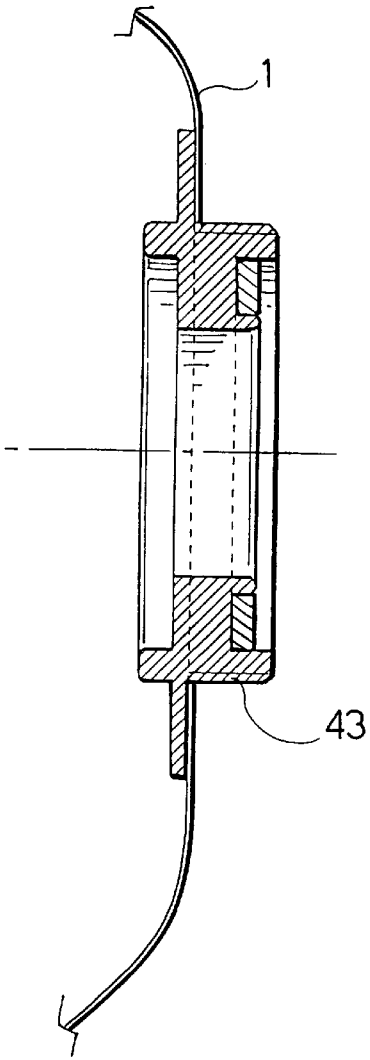

6
60
16
5
9
18
10
14
11
37
35
13
36
40
38
39
40
12
40
38
39
40
24
25
20
32
42
41
22
26
19
33

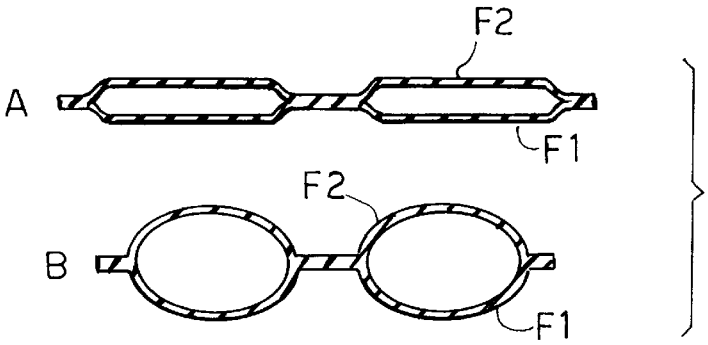
FIG. 12
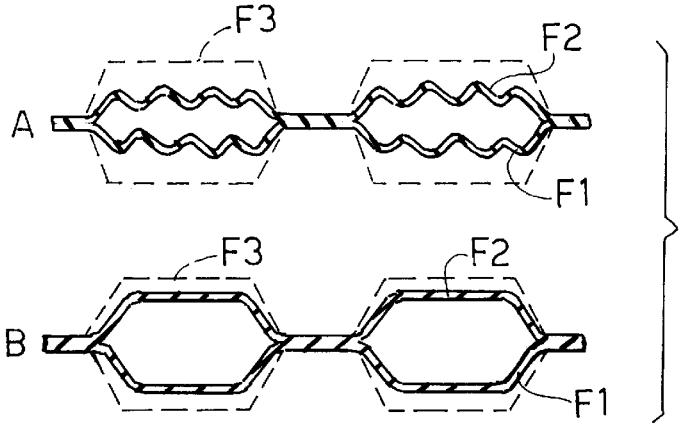
FIG. 13
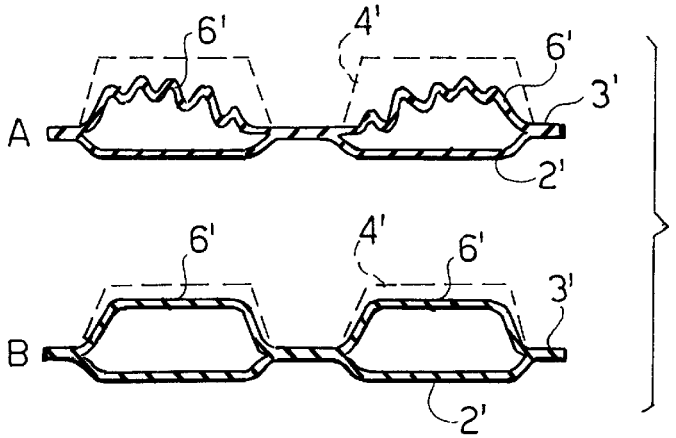
FIG. 14
FIG. 11
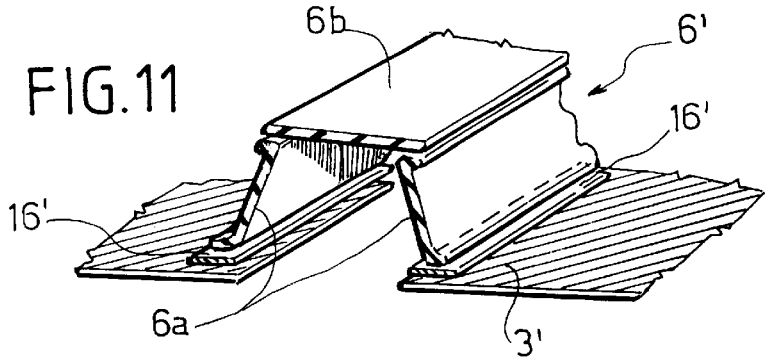

BUOYANCY COMPENSATOR FOR SCUBA DIVERS

FIELD OF INVENTION

The present invention relates to buoyancy compensators for scuba divers.

Buoyancy compensators (BCs) are generally made up of an air-tight inflatable vest; a harness system for connection to the diver's body; an inflation system which can be operated voluntarily (i.e., by the user) via a control and which is supplied with compressed gas, normally air from the breathing cylinder or cylinders by means of a hose which draws air at medium pressure downstream of the pressure regulator of the breathing apparatus; one or more discharge valves which are located in a hydrostatically advantageous position and which can be operated voluntarily by the scuba diver; one or more appropriately calibrated anti-burst automatic-discharge valves; and possibly a member for inflating by mouth on the surface of the water, which may also have the ancillary function of enabling the scuba diver to breathe the air contained within the vest.

It is evident that the primary functions, namely of inflation and discharge, must be performed with fast, easy and safe manoeuvres. It is in this direction that technology has in particular evolved through various generations of inflation and discharge systems.

STATE OF THE PRIOR ART

One first generation of buoyancy compensators for scuba divers was provided with the following: a push-button inflator valve, screwed directly on the vest in a ventral position, and hence easy to grip; a voluntary-discharge and anti-burst integrated valve secured to the vest and positioned on the diver's shoulder, which could be operated by pulling a short line ending with a special "pommel"; and a flexible or corrugated tube, provided with a valve mouthpiece for inflating by mouth and even also for breathing, whenever necessary.

A second generation of buoyancy compensators for scuba divers witnessed the appearance of a new member, referred to as "integrated inflator". This is a long corrugated pipe, the top end of which is connected to the vest by means of a voluntary-discharge valve, which can be operated by means of a rudimentary tie rod tucked away inside the corrugated pipe. The bottom end terminates with a gripping part, which, when pulled, operates the aforesaid tie rod, so bringing about discharge. Connected to the latter by means of a press-block coupling is the air-feed hose coming from the pressure regulator of the breathing apparatus. The assembly comprises a push-button inflator valve, which shuts off supply of the compressed air, and when the scuba diver operates the push-button provided, he modulates immission of the compressed air into the BC. A terminal valve, controlled by a second push-button, shuts off access to the vest, so enabling inflation by mouth, or possible breathing, or a further discharge manoeuvre, which proves somewhat complicated and laborious; namely, the user must get hold of the gripping part, lift it above his shoulders, and press the push-button.

The version described above—which is still by far the one most widely available on the market—is not without a number of unsolved problems. First of all, an anti-burst automatic valve is required, which involves added costs and encumbrance. In the second place, the problems of hydrodynamic friction are far from being solved, with the risk of the diver getting caught on things as a result of the inflator-pipe assembly which tends to float about in a position that is hard to find (the fact of not being able to find it immediately constitutes a major danger: the functions of inflation and discharge may be of extreme urgency). In the third place, the two push-buttons may be easily confused. In the fourth place, the discharging manoeuvre performed by pulling the corrugated pipe is altogether imprecise: the range of travel of the valve is only three or four millimeters, with the consequent risk of the corrugated pipe getting broken with extremely serious consequences (loss of buoyancy) The discharge manoeuvre performed by raising the hand operating device is, on the other hand, complicated and somewhat contrived, and requires far from ordinary self-control and aquatic skills.

In a third generation of buoyancy compensators for scuba divers, the discharge valve is remotely controlled by the hand operating device of the inflator, by means of a pneumatically controlled valve. When the scuba diver wants to discharge, he presses the push-button provided and, by means of a tube hidden inside the corrugated pipe of the inflator, he sends a pneumatic signal to the discharge valve located on his shoulder, the said discharge valve being pneumatically controlled. The advantage of this solution lies in the fact that the imprecise manoeuvre of "pulling the corrugated pipe" of the second generation is not required. One disadvantage is the greater complexity of the pneumatic servo-valve system, the risk of air leakages, and the need for maintenance and periodic replacement of the gaskets.

A fourth recent generation of BCs is described in the documents EP-A-921064 and EP-A-945339. The inflator with its traditional corrugated pipe disappears, whereas there appears an integrated control block, which is connected to the vest in a ventral position and which can be gripped by the user with his left hand, the air-feed hose being connected to said control block and two push-buttons being provided therein. The first push-button makes it possible to inflate the vest by opening the valve that shuts off the medium-pressure air coming from the air-feed hose. The second push-button, which is for discharge, sends a pneumatic signal by means of a system of pressurized tubes tucked away inside the vest to two or more pneumatically controlled discharge valves which open simultaneously. The evident advantages are that there no longer exists the effect of encumbrance, with the danger of the diver getting caught on things and having his movements hampered and slowed down by the corrugated pipe+air-feed hose ensemble floating about in an position that is anything but easy to define. Furthermore, the diver no longer has to move his hand to carry out the inflating/discharging sequences. Less evident, but serious, are the disadvantages: 1) The pneumatic control for discharge is somewhat primitive and imprecise. It cannot be modulated and is liable to burst open suddenly all the valves connected to it. The only way for discharging in a more or less modulated manner is a series of open-close-open-close manoeuvres. This procedure is difficult, and in a situation of emergency and mental confusion, dangerous. 2) The device consumes compressed air which is precious for breathing, increasing air consumption during diving, with consequent drain on autonomy. 3) At the end of diving, when the pressure in the cylinders is very low, the device might not operate on account of shortage of pressure; and yet, this is precisely the most delicate moment, when the scuba diver, who is light because the cylinders have almost run out (4 to 5 kg is the difference in weight between the cylinders at start of diving and end of diving), tends to float, being moreover in the process of surfacing. The increase in the specific volume of the air contained in the vest tends to cause "ballooning", which is very dangerous on account of the risk for the diver of phenomena of aeroembolism. At the very moment when the need for discharging air is impellent, the pneumatic servo control might get stuck on account of low pressure, with possible tragic consequences. 4) The constructional complexity of the mechanical-pneumatic ensemble is considerable. The device requires periodic maintenance, as well as checking and replacement of the numerous gaskets and flexible tubes, with an added complication if they are buried away somewhere inside the vest, and hence difficult to inspect.

A fifth generation is disclosed i U.S. Pat. No. 5,256,094, also providing a remote integrated control assembly, arranged in a ventral area of the vest which is easily accessible by the diver's hand, but not fixedly secured to the vest. This control assembly includes a first push-button or trigger to operate opening/closing of the discharge valve and a second push-buttom to activate the inflating system. The first push-button activates a remote control consisting of a cable connected to the discharge valve which in turn is applied to the rear area of one vest shoulder. The cable is housed within a simple tube, by pulling on any portion of which the discharge valve can be activated. As to the inflating system, this known control assembly is connected to the air supply hose and thus, through the second push button, to the vest via a long inflating flexible tube going up from the ventral area to the shoulder of the vest at which the inflating valve is also provided.

Also this known arrangement is affected by several drawbacks.

Firstly, the arrangement of the cable within the related freely extending tube makes opening operation of the discharge valve inaccurate and not al all safe: in fact, when the cable is subjected to traction following actuation of the first push-button of the control assembly, the disharge valve is also being pulled in its entirety, i.e. drawn towards the control assembly, owing to the limp and flexible nature of the vest tissue on which the valve is secured. Such a displacement of the discharge valve as a whole evidently leads to an unsteady opening performance of the valve, or even to uncomplete or failed opening thereof. On the other hand, the discharge valve is subject to the risk of undesired opening in case the tube along with the cable is housed be pulled from the outside, for instance following accidental hooking thereof by an underwater obstacle.

Secondly, the fact that the control assembly is not fixedly secured to the vest is a limit to access ease and convenience for the user. Thirdly, the inlet path of the inflating air through the long tube provided downstream of the control assembly involves huge losses of pressure downstream of the air expansion site, i.e. after the air has already expanded at a great specific volume. This rusults in practice into a very slow vest inflating, which is inadequate during regular buoyancy compensations and quite dangerous in emergency situations.

As regards the conformation of the inflatable vest, currently known buoyancy compensators for scuba divers can be basically divided into two types: "double-bag" ones and "single-bag" ones.

In general, and in the present context, by "double-bag" BC is meant a buoyancy compensator in which the bag is made up of an external bag and an internal bag, which are different and independent from each other. The internal bag in practice consists of a hermetic and inflatable inner tube, while the external bag consists of a resistant coating made of non-inflatable, inextensible woven fabric, which is permeable to air and to water, possibly also thanks to appropriate meshwork inserts or holes with eyelets.

In the case of "single-bag" BCs, the vest actually consists of a single bag, which is, at one and the same time, resistant and hermetic (in so far as it is made by welding peripherally at high frequency two layers or sheets of woven fabric spread with polyurethane), inflatable, inextensible, and resistant to pressure, abrasion, tearing and perforation.

The two traditional configurations described above are illustrated, by way of example, in FIGS. 12 and 13, which are schematic cross-sectional representations respectively of the single-bag structure, deflated in the case of FIG. 12A and inflated in the case of FIG. 12B, and of the double-bag structure, deflated in the case of FIG. 13A and inflated in the case of FIG. 13B.

At present, the constructional trend is generally in the direction of the single-bag structure, basically for economic reasons, reasons of an aesthetic nature (i.e., styling), and on account of the possibility of partial automation of the manufacturing process. The tendency is to use the double-bag configuration only when the aim is to achieve less customary results, such as larger inflation volumes, or else a greater softness of the parts that come into contact with the user's body. Recently, the single-bag structure has revealed its serious limits when manufacturers attempted to extend the inflatable area, beyond the ventral region, to include also the rear areas on either side of the compressed-air cylinder. In these cases, in order to achieve three-dimensional volumes, manufacturers were forced to adopt complex and costly structures on account of the welding requirements, the said structures moreover being far from effective owing to the small volume even so achieved and the poor "connection" to the diver's body of the floating items, which in practice drift about here and there in the water (see EP-A-0 974 514).

SUMMARY OF THE INVENTION

The primary object of the present invention is to provide, as far as the inflating and discharge functions are concerned, an innovative generation of buoyancy compensators for scuba divers, designed to achieve the advantages (where these exist) of the previous generations, while overcoming their drawbacks as referred above.

The above object is achieved mainly thanks to a buoyancy compensator for scuba divers as defined in appended claim 1. The pre-characterising portion of claim 1 reflects the prior art known from U.S. Pat. No. 5,256,094.

In summary, the buoyancy compensator according to the invention is provided with a device named "single control" which is operable both to inflate and to deflate the vest, wherein the single control is permanently secured to the vest at a fixed site which is easily accessible in a prompt way by one user's hand, and is also providing a direct and immediate inlet of the air through the securing site itself of the single control, i.e. via an extremely short low-pressure duct, and with a discharge function operating lever or trigger which actuates an inextensible cable slidable along a flexible but resistant-to-compression sheath which is backed at both opposite ends thereof, so that discharge sensitivity be constant and influenced neither by variations of the air volume within the vest, nor by the diver's movements in use, nor by crimping of the vest.

The so conceived single control assembly mainly performs two functions:

A. inflating of the inflatable vest, by means of a push-button operated valve and the like, fed with air through a quick-fit connector and a hose, from the main pressure section of the regulator. Inflating can be adjusted and modulated intervening both on the instantaneous flow rate (depressing more or less the push button) and on the actuating time. Air inlet into the vest is immediate: the path between the valve and inflatable chamber of the vest is only a few millimeters long and thus does not generate any relevant loss of pressure, whereby inflating is most prompt.

B. rapid and adjustable discharging of the air contained in the inflatable vest. The push button or trigger or lever mechanism pivoted on the single control body applies a direct traction onto the inextensible cable (preferably made of stainless steel or inextensible synthetic material). The cable, within the backed sheath, goes up from the ventral position to the shoulder entering the discharge valve therein, which operates a disk obturator by means of a rocker lever. The cable must necessarily be made of an inextensible material, i.e. it must not be subjected to any lenght changes either under traction stress or following umidity variations.

One peculiar aspect of the system according to the invention resides in the sheath backed at both ends. In one exemplary embodiment of the invention, the sheath is including several component elements fitted onto a helically wound spring coil made of stainless steel.

Differently from all the above-mentioned known solutions, namely that according to U.S. Pat. No. 5,256,094, the sheath is compulsorily provided to be both resistant to and unaffected by compression, i.e. it does not become shorter when subjected to compression. Actually, when the cable applies a traction strain (it is a stay wire), the sheath must react as a prop: in other words, it must avoid that when the diver operates the discharge push button or trigger provided on the single control, the discharge valve may move closer thereto owing to crimping of the vest.

Air discharge can be modulated in connection with the intantaneous flow rate of the discharged air, with the time length of the discharge action, and also with the total volume of the discharged air as a result of both the flow rate and time. It can thus be argued that both a "quick discharge" function (necessary to enable relevant and sudden variations of the buoyancy attitude) and a "fine discharge" function (i.e. a millimetrical buoyancy trimming adjustement) can be achieved by means of successive operating pulses onto the discharge trigger which are short in connection with both their operating stroke and time.

Another difference with respect to all the known mechanical solutions, which not having a backed sheath can perform air discharge in an unsafe and unreliable manner (namely only when the vest is by chance crimped only less than a certain amount), the solution according to the present invention is capable both to discharge large amounts of air (quick deflating) and to finely modulate the discharge amount (adjustement). Such, a modulation well distinguishes the invention over the known solutions according to the fourth generation disclosed in the above, which as already stated do not provide a fine discharge option since the pneumatic actuator of the discharge valve(s) can only be set on or off: such an arrangement in fact consists of a piston which "fires" the actuator either to the open or to the closed position, without any chances to modulate the stroke thereof. Its only modulating capability is bound to the manual actuating time, which is however really hard to perform in critically difficult underwater situations.

As compared to the buoyancy compensators according to the fifth generation (U.S. Pat. No. 5,256,094), the B.C. according to the invention also achieves a series of relevant advantages: by virtue of the cable sheath backed at both ends, the discharge valve as a whole is not shifted by the traction applied to the cable, whereby opening thereof is carried out in a safe and precise manner. Any risks of undesired opening owing to an accidental traction applied to the sheath, whose opposite ends are fixed, is also prevented: this advantage can even be further enhanced placing the sheath and cable assembly within a hidden and protected area of the vest. Moreover, fixedly securing the single control to the vest enables it to be easily found in use, and the direct connection between the air supply hose and the vest drammatically reduces any pressure losses thus ensuring inflating promptness.

The various functions and manoeuvres are intuitive to the user: without needing to look, the scuba diver brings his left hand onto his ventral region, locates the single control, grips it opposing his thumb to his other fingers. If he presses the inflating button with his thumb, the vest inflates; if he presses the finger control of the discharge lever with his forefinger and middle finger, the vest deflates, the two operations being performed in a simple, intuitive, ergonomic and fast way, with the amount of inflation or deflation which can be precisely modulated.

Additional advantages afforded by the buoyancy compensator for scuba divers according to the present invention may be summed up as follows:

1) It does not use the concept of "pneumatic interlocking of the discharge valve" described in reference to the third-generation and fourth-generation BCs. Consequently, it does not consume precious air, it operates also when the cylinder has run out, and, as compared to the fourth-generation BCs, it is not abrupt or rudimentary in its modulation.

2) The single control of the BC according to the present invention is easy for the scuba diver to locate with his hand and is connected directly to the BC, in a ventral position, and it is readily identifiable unlike the controls in the third- and fifth generation BCs.

3) As compared to all the corrugated inflators (both those of second-generation and those of third-generation BCs), it does not present any hydrodynamic friction, any danger of getting caught up in things, or any increase in overall dimensions.

Furthermore:

a) It enables concentration of the two primary functions of inflation and deflation in a fixed and accessible position, with an ergonomical advantage;

b) It enables graduated discharge with fine modulation by pressing on the lever for a greater or lesser number of millimeters (geometrical adjustment) and/or for a greater or lesser number of seconds (time adjustment).

c) It enables use, for discharge, of an ordinary discharge valve of the overpressure type for BCs, which, in addition to the manual-operation function, opens automatically when the pressure inside the vest exceeds the calibration value (anti-burst function).

d) It enables calibration of the discharge function by acting on the cable/sheath length, using simple mechanical means.

e) It does not require—as regards the discharge function—any pneumatic maintenance, such as periodic replacement of the gaskets, and does not present any risk of leakages.

It should be pointed out that the elements for controlling inflation and deflation could, instead of being grouped together in a single integrated assembly (single control), consist of physically separate members applied in areas of the BC that are just contiguous, or even separate. In any case, the function for control of discharge will come under a mechanical remote control made up of a flexible tie rod operated by a manoeuvring lever, more conveniently in the form of an automatically grippable hand operating device, which is immediately accessible by the user's hand and which can be actuated in a graduated and modulated way by opposition of the user's thumb to his other fingers.

Further secondary characteristics are defined in the subclaims 2–13.

Another particular object of the invention, with specific reference to the structure of the inflatable vest of the buoyancy compensator, is to overcome the drawbacks of the known arrangements disclodsed in the above, while achieving the peculiar advantages of the first and of the second known solutions.

According to the invention, this object is achieved by means of a buoyancy compensator for scuba divers.

In brief summary, the buoyancy compensator for scuba divers according to the invention presents a "mixed structure", i.e., a single-bag structure in the areas where this technological solution proves useful and advantageous because the said areas are subject to mechanical loads (on account of the presence of the harness, the attachments for valves and for the bottle(s), etc.), and a double-bag structure in the other areas, namely where there is a higher requirement of inflation to enable expansion without constricting the diver's chest during use.

According to a further otional feature of the invention, the buoyancy compensator of the invention may be provided with a self-supported ballast system which, instead of being fitted within receptacles arranged in the front area of the inflatable vest, as in the prior art, is housed in pockets or containers carried by wings of fabric or the like so as to surround the air bottle(s), and secured thereto by means of belts or straps, in a fixed fashion.

Three main advantages in use are thus achieved with respect top the traditional arrangements providing front "dangling" ballast receptacles:

1. the ballast does not compress any more the diver's chest or abdomen, particularly in the inflated condition of the vest;

2. the ballast mass is no more free to oscillate and hit the diver's body (when walking out of the water, when plunging, when climbing a boat ladder);

3. the center of gravity of the ballast is coinciding with the air bottle(s) volume (which, according to the Archimedes' principle is the center of gravity of the floating attitude of the bottle while it is being progressively discharged: as it is known, the weight of a 15 liter bottle under 200 bar, thus containing 3000 liters of compressed air, is reduced after discharge of 4 Kgs.), thus preventing upsetting couples.

BRIEF DESCRIPTION OF THE DRAWINGS

The invention will now be described in detail with reference to the attached drawings, which are provided purely by way of non-limiting example, and in which:

FIG. 7 is a sectioned view along line VII—VII of FIG. 3,

FIG. 11 is a cross-sectional view, at a larger scale, according to the line XI—XI of FIG. 10; and FIGS. 12A and 12B, 13A and 13B, and 14A and 14B are schematic cross-sectional views respectively illustrating operation of a known single-bag BC (FIG. 12), a known double-bag BC (FIG. 13), and the mixed-structure BC according to the invention (FIG. 14), in each case respectively in the deflated condition (A) and in the inflated condition (B).

DETAILED DESCRIPTION OF A PREFERRED EMBODIMENT OF THE INVENTION

Figure 1:
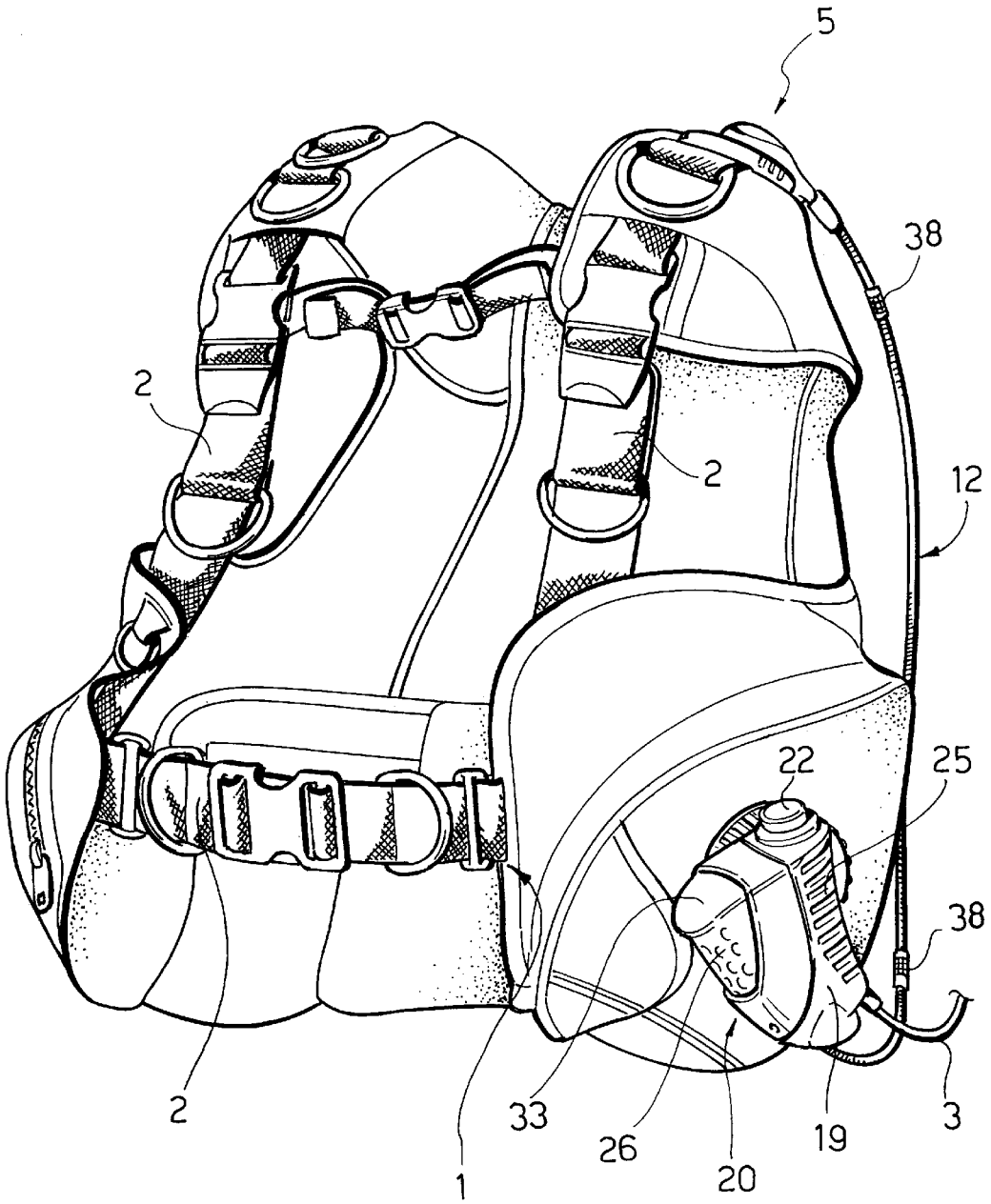
FIG. 1 is a schematic perspective view of buoyancy compensator for scuba divers according to a preferred embodiment of the invention.

In FIG. 1, the reference number 1 designates, as a whole, a hermetically sealed inflatable vest, which is normally able to withstand an internal pressure of over 0.8–1 atm. with respect to the outside environment. The vest 1, the general configuration of which may be conventional or else may correspond to the innovative structure described in more detail in the following with reference to FIGS. 9–12, can be donned by a scuba diver and then connected to his body by means of an appropriate adjustable harness 2.

As is known, by adjusting the volume of air contained in the vest 1, the scuba diver is able to modify his own buoyancy (hence the name "buoyancy compensator"), and consequently the set of his own position in the water.

The air inside the vest 1 is conventionally supplied from the compressed-air cylinder, or cylinders, normally applied and fixed to the back of the BC by means of the customary breathing apparatus and a flexible feed hose, illustrated in part and designated by 3.

The reference number 5 designates, as a whole, an air discharge valve, which chiefly performs the function of modulatable voluntary discharge. As will be seen, the valve 5 can also perform the function of anti-burst valve designed to open automatically when the pressure inside the vest 1 exceeds the ambient pressure by more than the calibration value of the valve itself.

Figure 5:
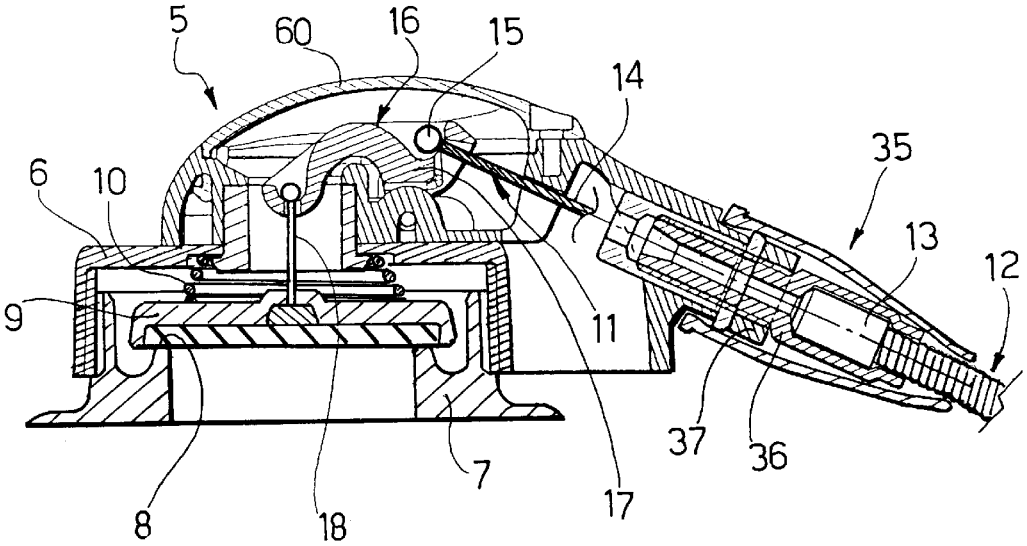
FIG. 5 is a partial cross-sectional view, at a larger scale, of the BC discharge valve.
Figure 6:
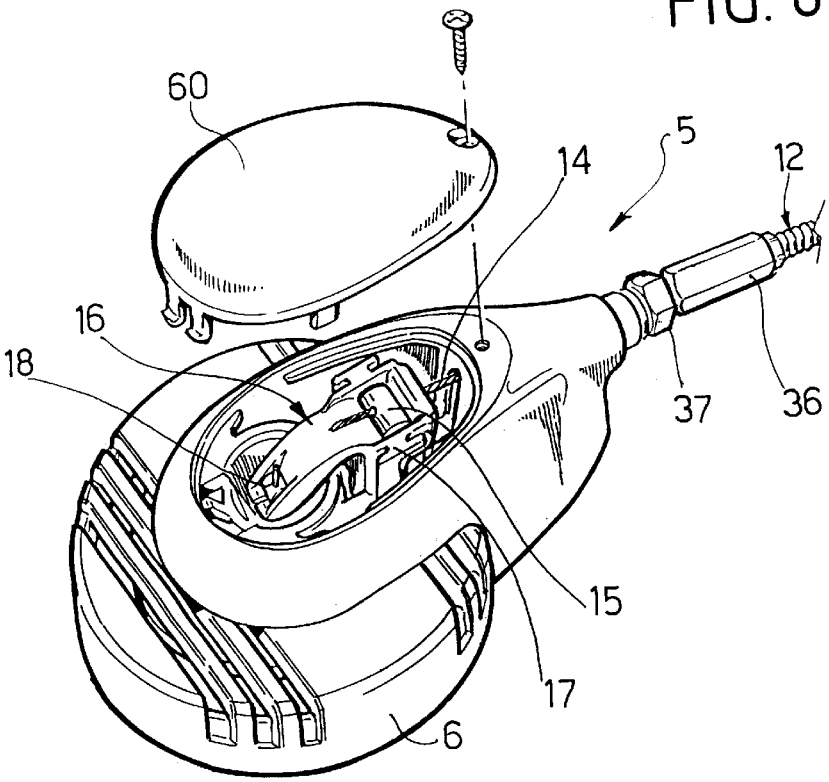
FIG. 6 is a partially exploded perspective top view of FIG. 5.

As illustrated in FIGS. 5 and 6, the discharge valve 5 is arranged in a hydrodynamical advantageous position on one shoulder of the vest 1 and comprises a body 6 with a cover 60, connected to a pipe union 7 which defines an annular valve seat 8, with which there co-operates a rubber-coated movable cup or obturator 9, which is normally kept closed against the valve seat by the action of a calibrated spring 10. When the pressure inside the vest 1 exceeds (normally by 0.2 bar) the external pressure, the obturator 9 automatically opens, so as to discharge the air contained inside the vest 1, thus preventing any risk of bursting.

The obturator 9 may also be operated in a voluntary way for discharging the air inside the vest 1 by means of a mechanical remote control consisting of a flexible cable 11, metallic and inextensible, that is slidable inside a sheath 12.

The sheath 12 is constituted by a stainless steel helical wire spring, whose coils are arranged into mutual contact preferably under a pre-load between each pair of adjacent coils such as to avoid that the contact be lost in case of flexion or anyway deformation of the sheath 12.

The end of the sheath 12 located on the side of the discharge valve 5, designated as 13, is fixedly secured to the body 6 by a rotatable device 35 enabling free rotation but no axial displacement thereof. A screw adjuster 36 and associated locking nut 37, similar to those employed in bycicle remote controls but made of totally stainless materials, allows easy adjustements of the end 13 and thus, as it will become apparent hereinafter, of the air discharge sensitiveness for the diver.

Figure 8:
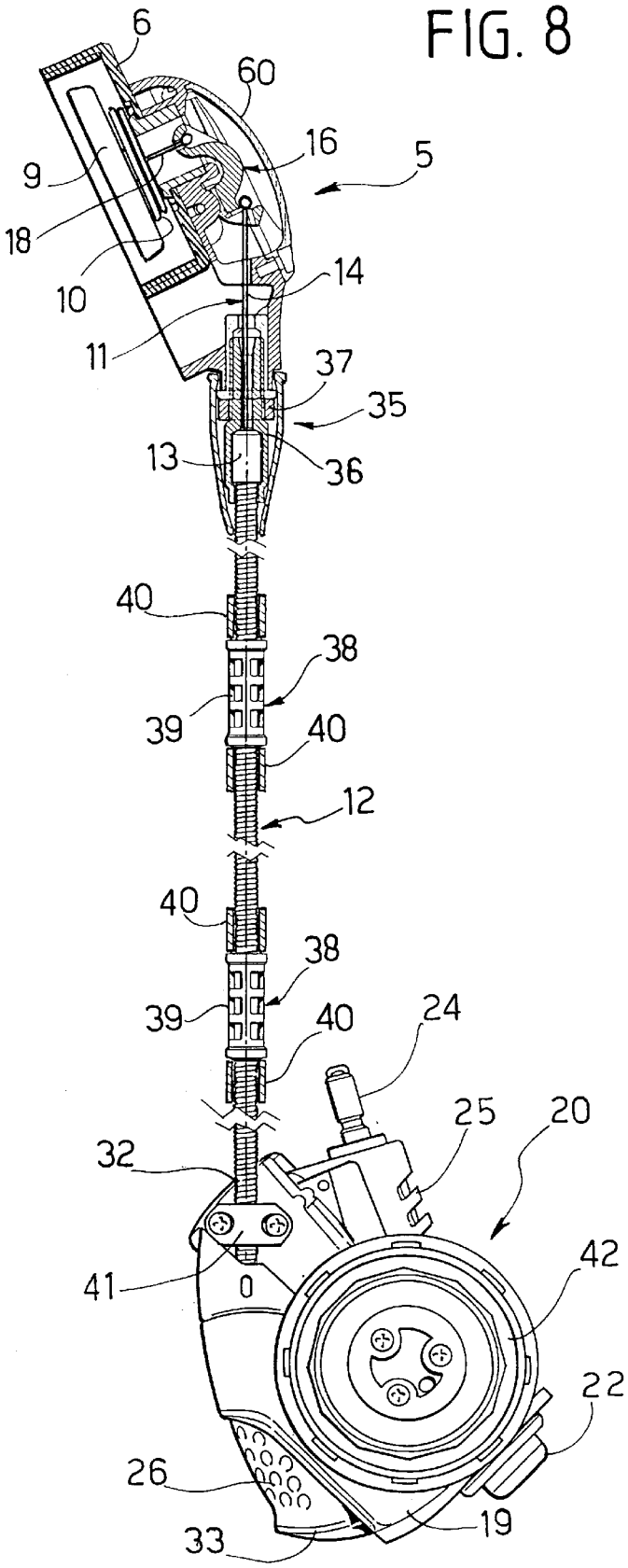
FIG. 8 is a partially sectioned elevational view of the line between the single control of FIGS. 2–4 and the discharge valve of FIGS. 5 and 6.
Figure 9:
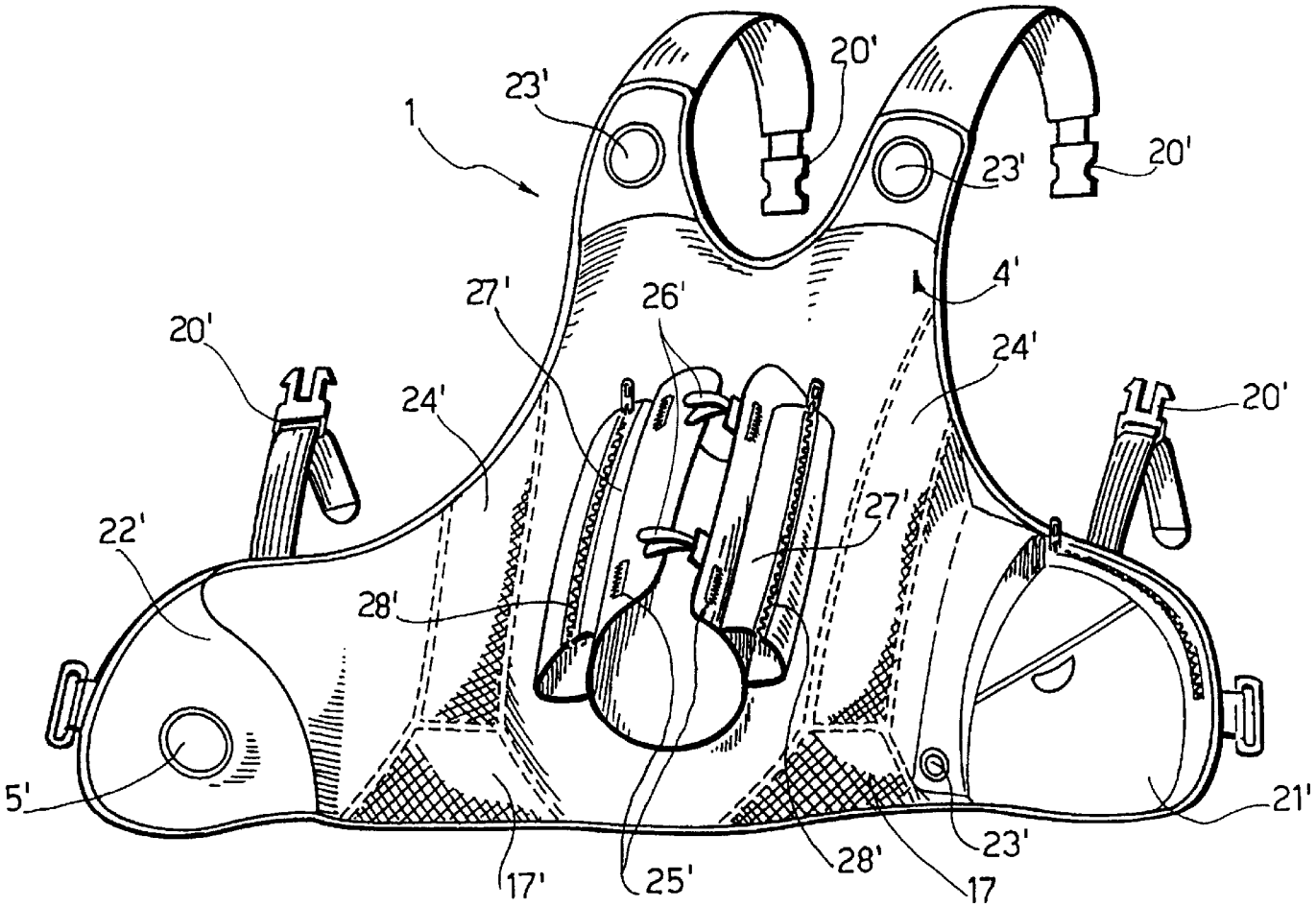
FIG. 9 is a schematic perspective dorsal view showing a preferred construction of the vest of the buoyancy compensator according to the invention.
Figure 10:
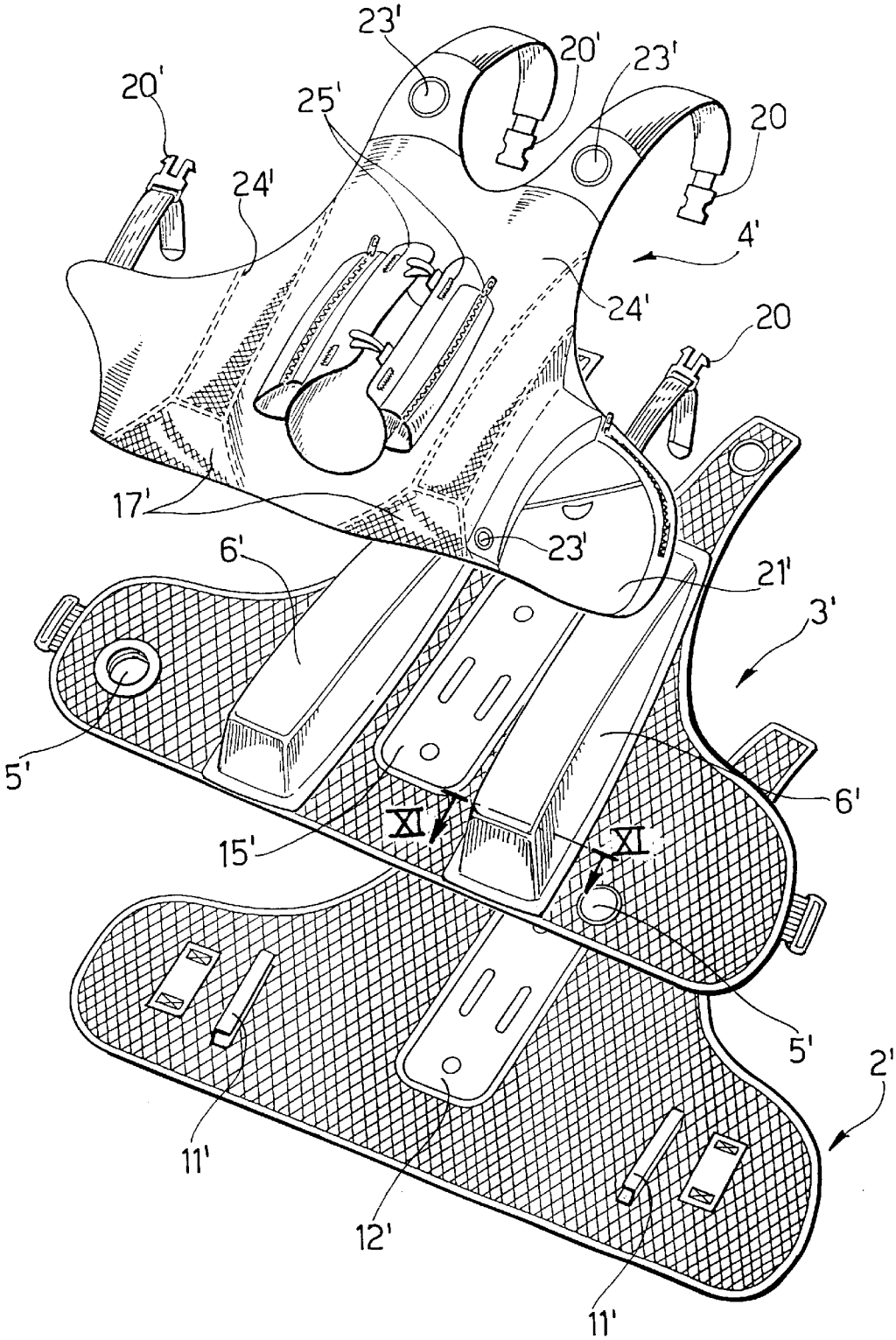
FIG. 10 is an exploded perspective view of FIG. 9.

Optionally, but advantageously, one, two or more drain sites 38 (FIGS. 1 and 8) are provided along the sheath 12, at which the spring coils are mutually spaced apart so as to allow release of the salt water after diving in the sea, and of the rinsing water. Pierced sleeves 39, backed at their opposite ends by bushes 40 that in turn are press-fixed onto the sheath 12, make these sites 38 totally unaffected by compression strains, as for the remaining parts of the sheath. This draining construction does not interrupt continuity of the inner diameter of the sheath 12, along which the cable 11 is slidably fitted.

The end 14 of the flexible cable 11 that comes out of the end 13 of the sheath 12 is anchored (possibly in an adjustable way by means of a pawl with displaceable screw 15) to an oscillating transmission member 16. The axis of oscillation of the transmission member 16, designated by 17, is conveniently mobile, thanks to the mode of assembly, as illustrated in FIG. 5.

Moreover connected to said transmission member 16, on the side opposite to the end 14 of the flexible cable 11, is a tie rod or stem 18, which is in turn fixed to the obturator 9.

It is clear that when a tensile force is applied to the flexible cable 11, the oscillating transmission member 16 rotates, so as to cause the obturator 9 to lift up and hence move away from the valve seat 8 against the action of the valve 10, thus enabling voluntary discharge of the air contained inside the vest 1.

It should be noted that the presence of the oscillating transmission member 16 is not strictly necessary, in that the flexible cable 11 could be directly connected to the stem 18 or else to the obturator 9. However, the solution illustrated enables a favourable ratio of levers to be obtained and any sliding friction in the control for opening the discharge valve 5 to be altogether eliminated.

In the case of the example illustrated, there is just a single discharge valve 5, which is set at the top left-hand side of the vest 1. This arrangement is not, however, strictly binding, even though it is considered preferable.

Figure 4:
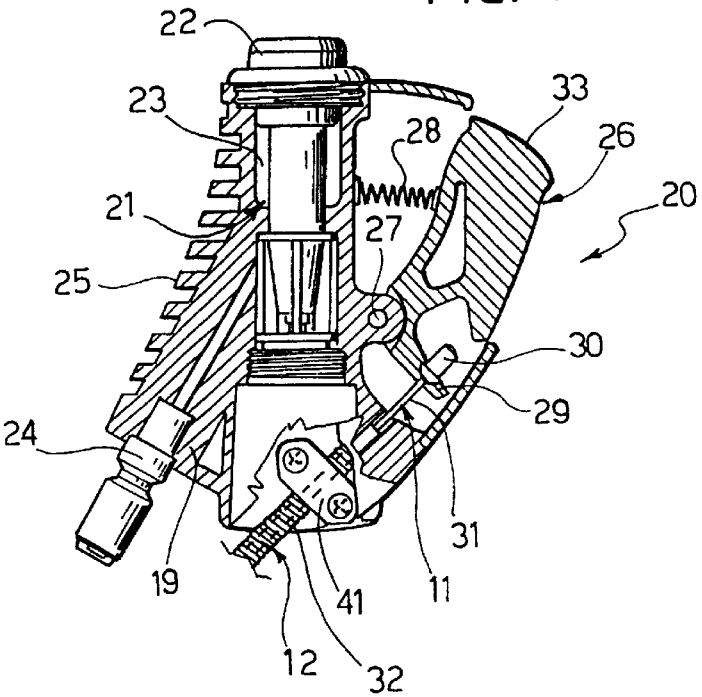
FIG. 4 is a partial cross-sectional view of the item illustrated in FIG. 2.
Figure 2:
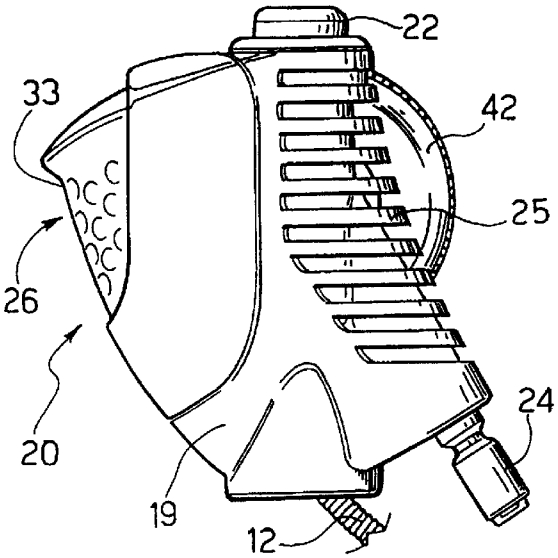
FIG. 2 is a side elevation, at a larger scale, of the BC single control.
Figure 3:
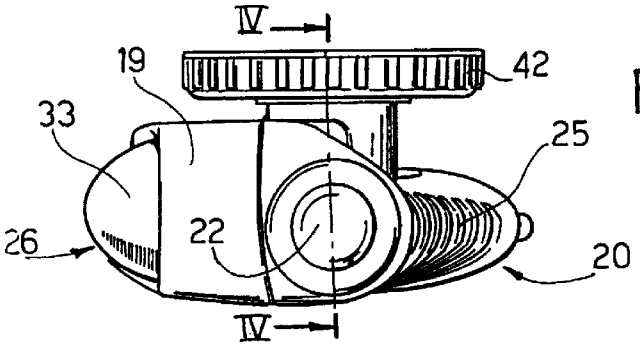
FIG. 3 is a top plan view of the detail illustrated in FIG. 2.

The other end of the sheath 12, namely its bottom end 32, is anchored and fixed (in the way represented in FIG. 4), for instance by means of a screw clamp 41, to the bottom part of a block 19, which is rigidly fixed to the bottom area of the left-hand side of the vest 1. This body 19, which is typically made of moulded plastic material, is normally fixed sealingly to the vest 1 by means of a threaded ring nut 42 designed to engage an annular connector 43 (FIG. 7) in turn permanently secured to the vest 1, and and constitutes the support for a single control, designated as a whole by 20. The previously described positioning of the block 19, and hence of the single control 20, is not to be understood in a limiting sense, but is undoubtedly preferable in so far as it is easy to locate and can be conveniently gripped by the user with his left hand. For this purpose, the block 19 is shaped at the front like an anatomically and ergonomically grippable hand operating device 25.

The single control 20 includes two sections, one of which is dedicated to the function of inflating the vest 1, and one to the function of discharging the vest 1.

The inflation function is performed by a shutoff valve 21 of an altogether conventional type, which can be operated by means of a control push button 22 arranged in the top part of the supporting block 19. The valve 21, which is normally closed, controls communication between an air-inlet pipe 23 for air intake into the vest 1 and a passage 24 of the block 19, which can be connected, by means of a press-block coupling of a conventional type (normally equipped with an automatic shutoff valve, which opens when it engages and closes when it disengages) to the flexible air-feed hose 3.

As shown in better detail in FIG. 7, the inlet pipe 23 is directly connected to the threaded ring nut 42, and thus to the inside of the vest 1, through a quite short passage 44 of the supporting block 19.

When the push-button 22 is pressed, the inflation valve 21 opens communication between the passage 23, i.e., the feed hose 3, and the inside of the vest 1, with absolutely negligeable pressure losses.

For controlling the discharge valve 5 previously described, a sturdy control trigger lever 26 is provided, which turns on a pin 27 (FIG. 4) carried by the supporting block 19 and projecting from the front part of the latter. The lever 26 is pushed towards an extracted position by the action of a spring 28 and is formed at the bottom with an attachment arm 29, to which is anchored, for example by means of an adjustable pawl 30, the other end 31 of the flexible cable 11 which projects from the end 32 of the sheath 12.

The top part of the lever 26 is shaped like a finger or tab 33.

During use, when the scuba diver wishes to discharge the air from the vest 1, either in an immediate way or in a modulated way as may be selected, he simply has to press the finger-like or tab-like end 33 of the lever 26 with his forefinger, so causing rotation thereof about the axis 27 against the reaction of the spring 28. In this way, an intense tensile force which may be easily modulated is exerted on the end 31 of the flexible cable 11 with a favourable ratio of amplification of the forces. The said tensile force produces, in an equally modulatable way, opening of the obturator 9 of the discharge valve 5.

The vest 1 may be provided, in a way that is not illustrated in so far as it is generally conventional, with a tube for inflation by mouth, the said tube being provided with an automatic mouthpiece altogether similar to the ones used on life jackets for airline passengers. In addition, the discharge valve 5 may be equipped with a member (for example, a rope with a pommel-shaped gripping part) designed to control emergency opening of the valve independently of operation of the lever 26.

According to another aspect of the invention, the vest 1 may have a novel and peculiar construction such as disclosed hereafter with reference to FIGS. 9–11 and 14.

Referring to these Figures, the vest 1 of the buoyancy compensator according to the invention is basically made up of two appropriately prepared sheets which are subsequently welded together around the periphery using high-frequency welding technology. The said sheets are designated, in the case of the bottom sheet by 2', and in the case of the top sheet by 3'.

The bottom sheet 2' is the one designed to come into contact with the diver's body when the BC is worn. Just as in the case of a traditional single-bag BC, the bottom sheet 2' is made of a hermetic woven fabric spread with polyurethane, which is resistant and inextensible.

The top sheet 3' is the one designed, when the buoyancy compensator vest 1 is worn, to face outwards towards the water. According to the invention, it has a mixed structure: in the areas where a high three-dimensional inflatability is not required, but rather a high mechanical resistance and ease of connection of peripheral members (valves, harness, air bottles, etc.), it is made of the customary resistant and hermetic woven fabric spread with polyurethane normally used in the case of single-bag BCs; in the dorsal regions, and possibly also in the ventral regions, where a high inflatability is required, elastic sheets of polyurethane are used without woven fabric, the said sheets corresponding to those normally used for the internal vest of traditional double-bag BCs. The said elastic sheets are pre-formed by three-dimensional welding in the form of easily expandable volumes.

Before being assembled on the bottom sheet 2', the top sheet 3' is normally prepared by first pre-welding the connection bases for the valves, designated by 5', onto areas made of sturdy woven fabric spread with polyurethane. Two pre-formed longitudinal bladders, designated as a whole by 6', are then prepared separately. These are made of an elastic sheet of polyurethane welded in three-dimensional form, and are subsequently welded to the parts made of woven fabric that are not designed for other functions (e.g., attachments for the belt, air cylinder, shoulder straps, eye hooks for transporting objects, pockets, etc.).

The aforesaid subassembly is then welded peripherally on the bottom sheet 2'. The two inflatable volumes defined by the pre-formed bladders 6' are thus connected and integrated with the overall volume of the vest defined by the connection between the bottom sheet 2' and the top sheet 3'. Thanks to their three-dimensional structure and their elasticity, the said bladders 6' can be easily inflated from a "zero volume" to a volume of several liters, so exerting a strong buoyancy on the scuba diver. In the case, as in the example illustrated, where the two bladders 6' are located on opposite sides of the area designed to receive the compressed-air cylinder, the buoyancy is located centroidally around the cylinder, so guaranteeing hydrostatic equilibrium perfectly free from moments that might cause overturning.

Obviously, if the construction of the vest of the BC were to stop at this point, the two longitudinal bladders 6' would be unprotected: since, as has been said, they are made of pure polyurethane sheeting, they would in fact be subject to bursting or to abrasion, tearing or perforation. For this reason, they are provided with a protection, as in a conventional double-bag BC, in the form of an external resistant coating, which may even be only partial (i.e., the protection possibly does not extend over the complete BC, but is limited to the areas of the two bladders 6'). In order not to reduce the inflatability of the bladders 6', the said coating, which is designated as a whole by 4' in the drawings, is made of resistant woven fabric or woven mesh and will be made so that it is ample, for example by means of special pleats.

With reference in greater detail to the drawings, the bottom sheet 2', which, as has been said, is made totally of woven fabric spread with polyurethane and is hence inextensible, resistant, and inflatable, has a peripheral border 7' which is designed to be welded to the analogous peripheral border 8' of the top sheet 3'. The bottom sheet 2' may have seams 9' which are rendered hermetic by means of welded patches 10' for attaching the loops for the ventral belt of the BC. Inflation limiters 11' are designed to be welded on one side to the bottom sheet 2' and on the other to the top sheet 3', and perform the same role as that of quilting in a mattress.

The bottom sheet 2' moreover has a welded perimeter 12' which isolates a region 13' that has attachments 14' for the cylinder and the back of the BC. The said welded perimeter 12' may be reinforced with layers of abrasion-resistant fabric.

In addition to having hemmed holes 5' for attachment of the valves and the welded perimeter 15' homologous to the welded perimeter 12' of the bottom sheet 2' for circumscribing the attachments 14', the top sheet 3' has, as has been said, the two longitudinal bladders 6', which are set on either side of the welded perimeter 15'.

As illustrated in greater detail in FIG. 11, each bladder 6', made, as has been said, of a sheet of polyurethane not coated with fabric, and hence elastic and easy to weld in three-dimensional shapes, may protrude less in the top region, or else have a cross section shaped so that it is tapered towards the outside, the purpose being to improve the hydrodynamic behaviour of the BC, i.e., its penetration in the water when the diver is swimming. In greater detail, each bladder 6' may be made up of elements 6*a,* 6*b,* and 6*c* which are substantially plane (in the undeformed condition), the edges of said plane elements being joined together by welding. The bottom sides of the elements 6*a*–6*c* are in turn welded to the inextensible fabric of the top sheet 3' by means of welding flanges 16'.

The resistant coating 4' performs, as has been said, the function of protecting and containing the bladders 6', also providing other functional and aesthetic features. The said coating is normally made of sturdy, non-inflatable fabric which is permeable to air, with possible inserts 17' made of meshwork, designed to facilitate draining away of the water. In the case of the example illustrated, the resistant coating 4' is provided with attachments 20' for the harness, a pocket 21' for carrying various objects, and an empty area 22' for enabling access to the single control unit 20 previously disclosed for manual control of the inflation and discharge system of the BC.

Furthermore, the resistant coating has appropriately worked regions or hemmed holes 23' for access to the various valves, and is formed with two longitudinal regions, designated as a whole by 24', which have an ample extension, i.e., a pleat configuration, to receive the two bladders 6', enabling expansion thereof in their inflated condition.

The central region of the coating 4' set between the regions 24' is designed for attachment of a compressed-air cylinder or bottle to the BC. Optionally provided for said attachment are two bands 25' with corresponding straps 26', which increase the stability of the attachment of the cylinder to the BC and possibly co-operate with the belt provided with cam-type buckles which is normally used for connection between the BC and the cylinder. Optionally, two longitudinal pockets 27' may be applied in the said region, which are provided with corresponding zip fasteners or other types of fasteners 28', and which are advantageously designed to accommodate ballast or heavy objects (e.g., batteries for illuminators or the like), in a centroidally favourable position with respect both to the weight of the cylinder and to the two floating objects consisting of the two bladders 6'. This solution moreover affords the advantage that the ballast is practically fixed to the compressed-air cylinder, instead of dangling in the pockets of the BC as in currently known solutions.

In addition, to the aforesaid bands 25' there may be advantageously anchored, either in a fixed or in a removable way, a system of handles for carrying made of a textile material, moulded plastic, or metal, designed to enable transport of the heavy BC+cylinder ensemble in a horizontal position, the said system of handles being centred with respect to the centroid of the ensemble.

As already mentioned previously, FIGS. 12, 13 and 14 are diagrams comparing the behaviour, respectively of a conventional single-bag BC (FIG. 12) and a conventional double-bag BC (FIG. 13) with a BC having a mixed single-bag/double-bag configuration according to the invention (FIG. 14). In FIG. 12, the references F1 and F2 designate the two elastic and extensible sheets of the single-bag structure, to which is added, in the case of FIG. 13, which regards the double-bag structure, the resistant and permeable external vest, designated by F3. From the comparison between the above figures it is evident how the mixed-structure conformation according to the invention makes it possible, with a construction which is anyway simplified with respect to the double-bag structure, to avoid the drawbacks present in the single-bag structure, namely deformation in the inflated condition (FIGS. 12B–14B), with the advantageous effect of preventing constriction of the diver's chest during use.

Advantages of the Invention

The control assembly made up of the lever 26 and the sheathed cable 11 is altogether similar to the brake control of a bicycle. The power of operation and the modulatability of the discharge are ensured by the opposition of the thumb to the other fingers of the user's hand. Uncontrolled pulls are not possible, such as those on the "pommel-type" control tie rods and on the corrugated pipe (as in the case of known second-generation BCs described above). As a result, discharge of air is precise and extremely smooth.

Since the single control is fixedly fastened on the vest in a ventral position, it can be located easily and reliably, unlike the old inflators (second-generation and third-generation ones), which float about here and there in the water near to the diver and are frequently impossible to locate, as well as unlike the old shaped pommels, which regularly get entangled in the harness and are nowhere to be found when needed.

The old problems of parts that can catch on things and of tubes that drift about freely in the water and slow down and hamper the diver's movements (corrugated pipe, hose connected to the free end of the inflator) are altogether solved. In addition, there is the advantage of being able to tuck away both the flexible sheath and the air-feed pipe for inflation inside pockets made of fabric, with readily understandable advantages in terms of compactness, absence of any danger of things getting caught up, and improved hydrodynamics.

The diver is able to carry out the inflation/discharge manoeuvre without displacing his left hand: he simply has to operate the button with his thumb or the lever with his forefinger, with big advantages in terms of simplicity, comfort, and safety, which were hitherto unthinkable.

The discharge action is made efficient, sensitive, intense and finely adjustable by virtue of the fact that the stay cable11/backed sheath 12 system is totally uninterested by shape variations of the inflatable vest 1, by the different positions of the diver underwater, and by crimping of the vest 1 during deflation.

Actually, defining as "L" the curvilinear distance between the attachment ends of the cable 11 on the single control 20 and on the discharge valve 5, respectively, and defining as "l" the curvilinear distance between the fastening ends of the backed sheath 12 relative to the single control 20 and to the discharge valve 5, respectively, which are both variable for the different buoyancy compensators according to the following exemplary table which is related to a definite BC type or model:

| Size | Length L of cable 11 | Length 1 of sheath 12 | Difference |
|---|---|---|---|
| X-small | 775 | 690 | 85 |
| Small | 825 | 740 | 85 |
| Medium | 865 | 780 | 85 |
| Large | 905 | 820 | 85 |
| X-large | 945 | 860 | 85 |

the difference between "L" and "l" is constant and unvariable because both the cable 11 and the sheath 12 are unextensible, and the sheath 12 is fixedly secured and thus backed at both ends 13 and 32 thereof.

Further important advantages reside in the adjustement capability of the length of the sheath 12, and thus of the control sensitiveness of the discharge valve 5 allowed to the user by the screw adjuster 36 and related nut 37, and in the direct connection for the air supply from the hose 3 to the inside of the vest 1, which drastically reduces the losses of pressure thus ensuring inflating promptness.

Moreover it may be readily understood that the buoyancy compensator vest according to the present invention is devised in such a way that the areas with double-bag structure are hidden away out of sight also for aesthetic reasons and integrated with the remaining part of the bag, in such a way that the buoyancy compensator, as in the case of a normal single-bag BC, is compact and hydrodynamically designed for favouring swimming and moving in water.

Variant Embodiments

The following variant embodiments may be envisaged in the framework of the present invention.

As already clarified previously, the elements for controlling inflation and discharge could, instead of being grouped together in a single integrated assembly (single control 20), consist of physically separate members applied in areas that are just contiguous, or else even in separate areas of the BC.

The flexible sheath 12 of the mechanical remote control for discharge may be completely tucked away in a pocket outside the inflatable vest (the said pocket being sewn or else being openable by means of a zip fastener or a Velcro strip) for the entire distance between the single control and the discharge valve.

The inflation hose 3, instead of passing from the first stage of the breathing apparatus to the inflator over the diver's left shoulder, could be passed under the diver's left armpit. Also the inflation hose 3 can be tucked away in an openable pocket, the entire arrangement being extremely advantageous on account of the absence of items that can get caught up on things, as well as on account of the absence of hydrodynamic friction, and danger of tears (provided that the female part of the press-block coupling can be easily engaged and disengaged also during diving).

optionally, the upper end of the inflation hose 3 may be secured to the upper area of the vest 1 (namely to the left shoulder zone) and terminate therein with a quick-fit connector designed to be coupled with a complementary part of a second extremely short air hose directly connecting the air regulator with the left shoulder zone.

As regards the inflation function, it is possible to envisage that the air at a reduced pressure supplied downstream of the inflation valve 21 located in the single control 20 can be guided , by means of a special system of tubes,towards various sections of the inflatable vest that can be hermetically separated from one another, or else simply at a mutual distance, for example in the left-hand ventral region and in the right-hand ventral region, separate or together, shoulders and back separate or together, in order to achieve particular effects in locating the volumes of hydrostatic thrust.

Again as regards inflation, it is possible to envisage that the press-block coupling of the supply hose 3 may enable, in the event of jamming of the inflation valve 21 in the open position, immediate disconnection of the hose, so blocking supply and preventing any dangerous "ballooning", with consequent serious risk, for the diver, of decompression sickness due to aeroembolism.

As far as the discharge function is concerned, it is possible to envisage that both of the, different, discharge valves 5 (in fact, even more than two may be present), for example one located on the diver's shoulder and the other towards the small of his back can be operated either simultaneously, by means of two cables connected to a single control lever, or else separately, by means of two cables connected to two different levers, for example levers which are pivoted on one and the same pin and which can be operated either separately or simultaneously.

The presence may moreover be envisaged, for the purpose of "inflation by mouth" on the surface of the water, of a special tube which includes, at its free end, an automatically closing mouthpiece: when the diver rests his lips against the mouthpiece, the valve opens and enables inflation of the vest by mouth, for example prior to diving or in the absence of other sources of air, in order to check perfect tightness of the vest.

For example, although in the example illustrated in FIGS. 9–11 and 14 only two dorsal bladders 6' are envisaged, according to a non-illustrated variant similar bladders could be provided also on the ventral side of the BC. In addition, a further elastic bladder could also be provided in the top part of the BC, in such a way as to surround the user's neck for approximately 180° or more, thus also having the function of supporting the diver's head out of the water. The aforesaid auxiliary bladder could be a single bladder or be divided into one or more areas.

It is moreover possible to envisage, in another variant embodiment not illustrated in the drawings, that the top sheet, instead of having a mixed structure consisting of regions made of inextensible fabric and regions made of elastic polyurethane sheeting welded together, has, instead, a substantially homogeneous structure, entirely made of elastic sheeting, which is able to inflate softly to achieve large volumes in all its areas, and possibly is only reinforced around the attachments for the valves or in other areas more subject to stress, and in any case circumscribed.

Of course, without prejudice to the principle of the invention, the details of construction and the embodiments may vary widely with respect to what is described and illustrated herein purely by way of example, without thereby departing from the scope of the present invention as defined in the ensuing claims.

What is claimed is:

1. A buoyancy compensator for scuba divers, comprising an air-tight inflatable vest (1), an inflation system (3, 21) which can be operated to set said inflatable vest (1) in communication with a source of compressed air, a discharge system including at least one discharge valve (5) which can be operated to set said vest (1) in connection with the external environment, manual control means for operating said inflation system and manual control means for operating said discharge system carried by a support body so as to define a single control assembly (20) provided at an easily accessible front-side region of said vest (1), wherein said manual control means for operating said discharge system (5) comprise a mechanical remote cable control (11, 12, 26), wherein:

said support body (19) of said single control assembly (20) is substantially rigidly secured in a sealed fashion to said vest (1) at a fixing site (42, 43) and is arranged to directly supply into the vest (1), through said fixing site (42, 43) itself, the compressed air delivered by said source;

said cable (11) is inextensible and is slidable within a compression-resistant flexible sheath (12) whose ends (13, 32) are backed onto said discharge valve (5) and said support body (19) of said single control assembly (20), respectively.

2. Buoyancy compensator according to claim 1, comprising means (15, 30) for adjusting the length of said sheath (12).

3. Buoyancy compensator according to claim 1, wherein said sheath (12) is formed by a metallic helical spring having mutually contacting and compressed coils.

4. Buoyancy compensator according to claim 3, wherein said sheath (12) has drain sections (38) at which said spring coils are mutually spaced apart.

5. Buoyancy compensator according to claim 4, wherein said drain sections (38) include pierced sleeves (39) and associated end bushes (40) fixedly secured on said sheath (12) so as to retain said pierced sleeves (39) thereover.

6. Buoyancy compensator according to claim 1, wherein said discharge system comprises an oscillating trigger lever (26) connected to said cable (11) to operate opening of said at least one discharge valve (5) selectively in a progressive and modulatable fashion, or else instantaneously.

7. Buoyancy compensator according to claim 6, wherein said oscillating lever (26) has an operating portion (33) consisting of a finger tab.

8. Buoyancy compensator according to claim 1, wherein said at least one discharge valve (5) includes an obturator (9) which can be translated between a closed position and an open position, and in that an oscillating transmission member (16) is provided between said obturator (9) and said cable transmission (11, 12).

9. Buoyancy compensator according to claim 6, wherein said manual control means (3, 21) for operating said inflation system comprise a normally closed shutoff valve (21) arranged within said support block (19) of said single control (20), and a push button (22) set adjacent to said trigger lever (26) and operable to open said shutoff valve (21).

10. Buoyancy compensator according to claim 1, wherein said front-side region is located on the left-hand side of said vest (1), in a position that is easily accessible for the user's left hand.

11. Buoyancy compensator according to claim 9, wherein said supporting block (19) of said single control (20) is formed with a connector (24) for fast connection of a compressed air hose (3), said connector (24) being connected, through said shutoff valve (21) and via a short inner passage (44) of said support block (19 ) of said single control (20), with a ring member (42) sealingly fixing said support block (19) to said vest (1) of the buoyancy compensator.

12. Buoyancy compensator according to claim 1, wherein said at least one discharge valve (5) operates also as an automatically opening anti-burst valve.

13. Buoyancy compensator according to claim 1, comprising a plurality of discharge valves (5), at least part of which are operatively associated to said remote control (11, 12, 26).

14. Buoyancy compensator according to claim 1, wherein said inflatable vest (1) has both inextensible inflatable parts (2', 3') arranged in areas basically subjected to mechanical stresses, and flexible inflatable and/or elastically extensible parts (6') arranged in areas where convenient expandability in three-dimensional volumes is required, said inflatable parts (6') being protected by a resistant, inextensible, water-permeable containment layer (4').

15. Buoyancy compensator according to claim 14, wherein said inflatable parts are made up of two longitudinal bladders (6') arranged along at least two longitudinal dorsal regions of the buoyancy compensator located on opposite sides of a central attachment region (25', 26') for attachment of at least one compressed-air bottle.

16. Buoyancy compensator according to claim 15, wherein between said two longitudinal bladders (6') and said central dorsal region (25', 26') two pockets (27') suitable for containing ballast and the like are arranged, said pockets (27') being fixed around said bottle by means of a system of bands (25') and straps.

* * * * *